US005417092A

United States Patent [19]

Iu

[11] Patent Number: 5,417,092

[45] Date of Patent: May 23, 1995

[54] PADLOCK

[76] Inventor: Chien-Chzh Iu, No. 24, Chi-An St., Kang-Shan Chen, Kaohsiung Hsien, Taiwan, Prov. of China

[21] Appl. No.: 253,086

[22] Filed: Jun. 2, 1994

[51] Int. Cl.[6] ..... E05B 67/24

[52] U.S. Cl. ..... 70/38 A; 70/39; 70/386

[58] Field of Search ..... 70/38 A, 39, 38 G, 38 R, 70/38 B, 38 C, 233

[56] References Cited

U.S. PATENT DOCUMENTS

| | | | |
|---|---|---|---|
| 2,479,199 | 8/1949 | Bennett et al. | 70/38 A X |
| 3,979,931 | 9/1976 | Man | 70/38 A |
| 4,290,279 | 9/1981 | Fish et al. | 70/38 A |
| 4,290,280 | 9/1981 | Yun | 70/38 A |
| 4,881,387 | 11/1989 | Kortenbrede | 70/39 |
| 5,186,029 | 2/1993 | Myers | 70/38 A |
| 5,189,893 | 3/1993 | Kortenbrede | 70/38 G X |
| 5,230,231 | 7/1993 | Liou | 70/38 A |

*Primary Examiner*—Peter M. Cuomo
*Assistant Examiner*—Monica E. Millner
*Attorney, Agent, or Firm*—Varndell Legal Group

[57] ABSTRACT

A padlock which includes a casing, a shackle having spaced grooves on two opposite ends thereof, a gear driven by the spindle of the lock cylinder thereof, two sliding lock plates driven by the gear to lock the shackle in the casing in any of a series of locking positions, and spring and steel ball sets respectively fastened to the locating block at the bottom and releasably engaged into each groove on either end of the shackle to ensure accurate locking.

3 Claims, 4 Drawing Sheets

PADLOCK

BACKGROUND OF THE INVENTION

The present invention relates to padlocks, and more particularly to such a padlock that the shackle can be locked in any of a series of locking positions to fit the dimension of the object being fastened.

The shackles of regular padlocks are made as large as possible so that they can lock objects of different dimensions (see FIG. 1). However, when a padlock is locked, a big space is left within the shackle. Therefore, a lever can be easily inserted through the gap within the shackle and turned to damage the shackle (see FIG. 2). If the gap is large enough, a jack may be inserted into the gap and operated to separate the shackle from the casing of the padlock.

SUMMARY OF THE INVENTION

The present invention provides a padlock which eliminates the aforesaid problems. According to the preferred embodiment of the present invention, the padlock comprises a casing, which has two parallel shackle holes through two opposite ends thereof, a shackle, which has spaced grooves on two opposite ends thereof and is detachably fastened to the shackle holes of the casing, a gear driven by the spindle of a lock cylinder thereof, two sliding lock plates driven by the gear to lock the shackle in the casing any of a series of locking positions, and spring and steel ball sets respectively fastened to the locating block at the bottom and releasably engaged into each groove on each end of the shackle to ensure accurate locking.

DETAILED DESCRIPTION OF THE PREFERRED EMBODIMENT

Figure 2:
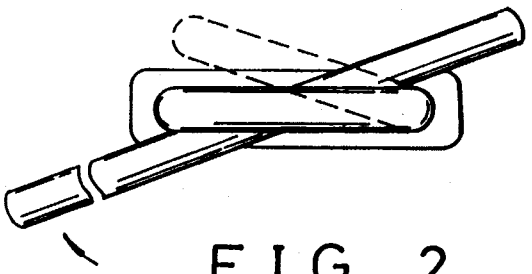
FIG. 2 PRIOR ART
FIG. 2 shows a lever inserted through the shackle of the padlock of FIG. 1 and turned to damage the shackle.
Figure 3:
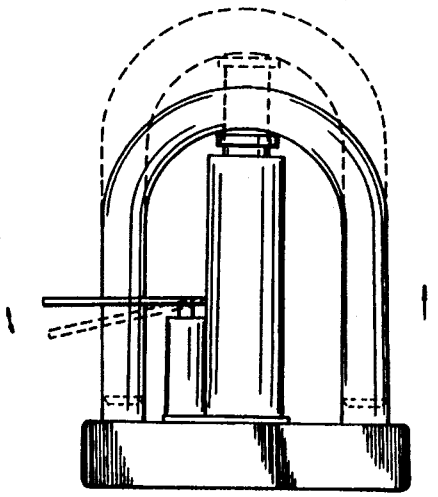
FIG. 3 PRIOR ART
FIG. 3 shows a jack operated to separate the shackle of the padlock of FIG. 1 from the casing thereof.
Figure 1:
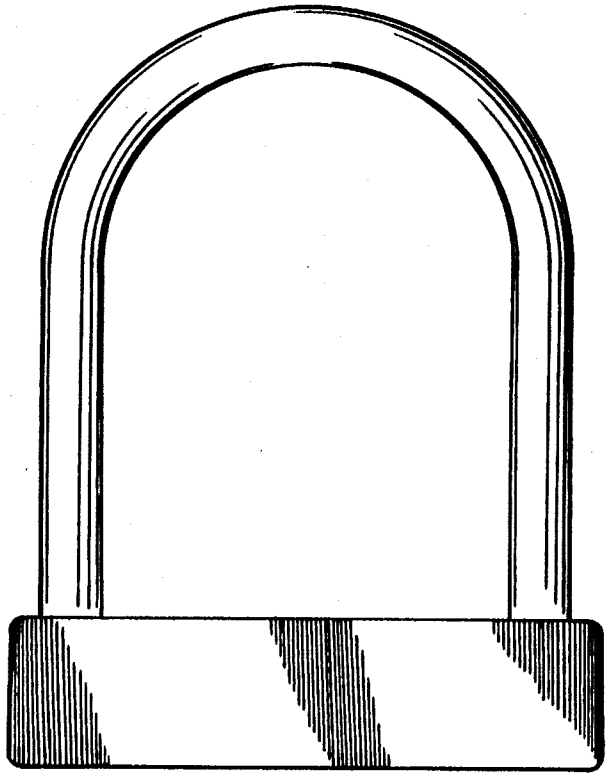
FIG. 1 PRIOR ART
FIG. 1 is a front view of a padlock according to the prior art.
Figure 4:
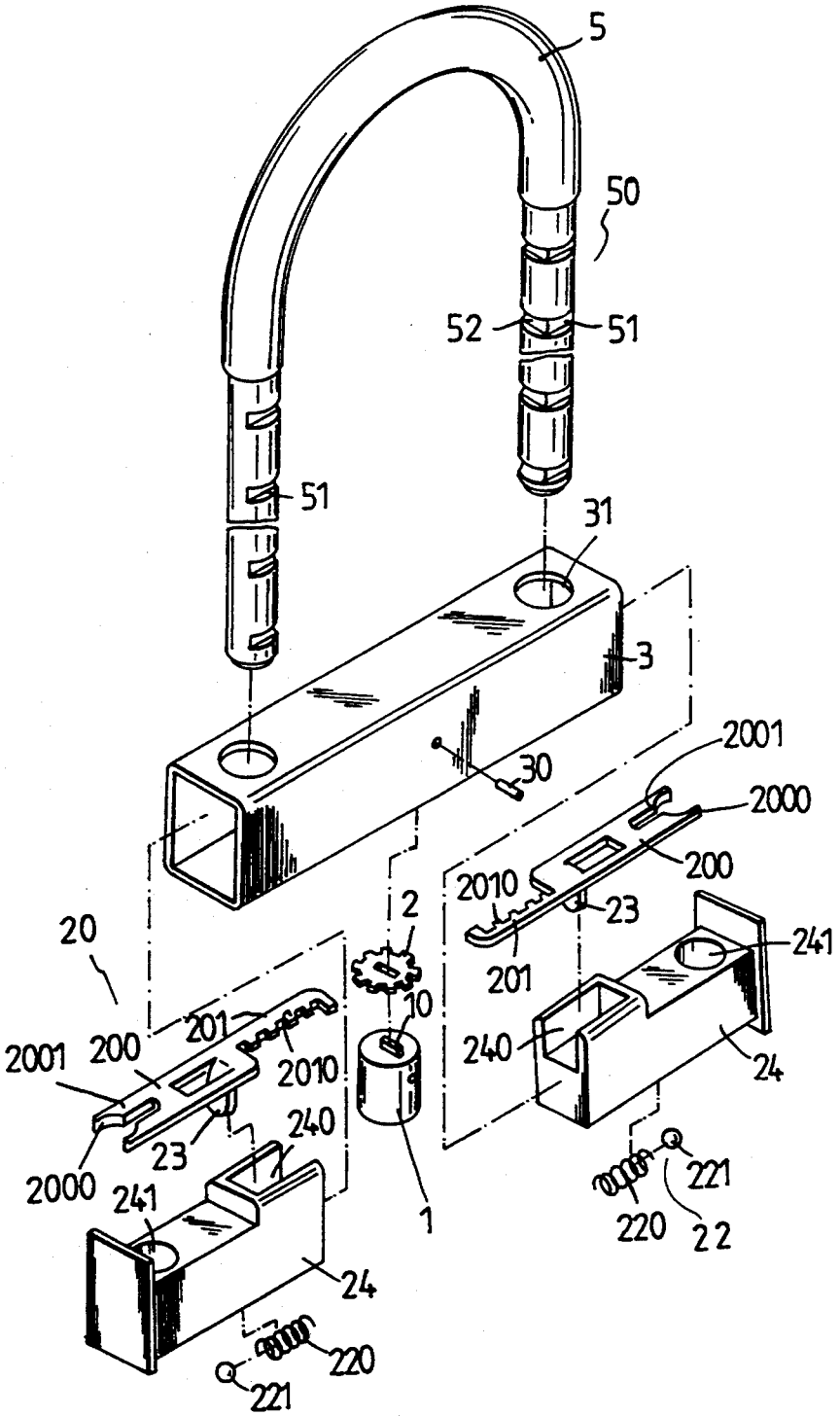
FIG. 4 is an exploded view of a padlock according to the present invention.
Figure 5:
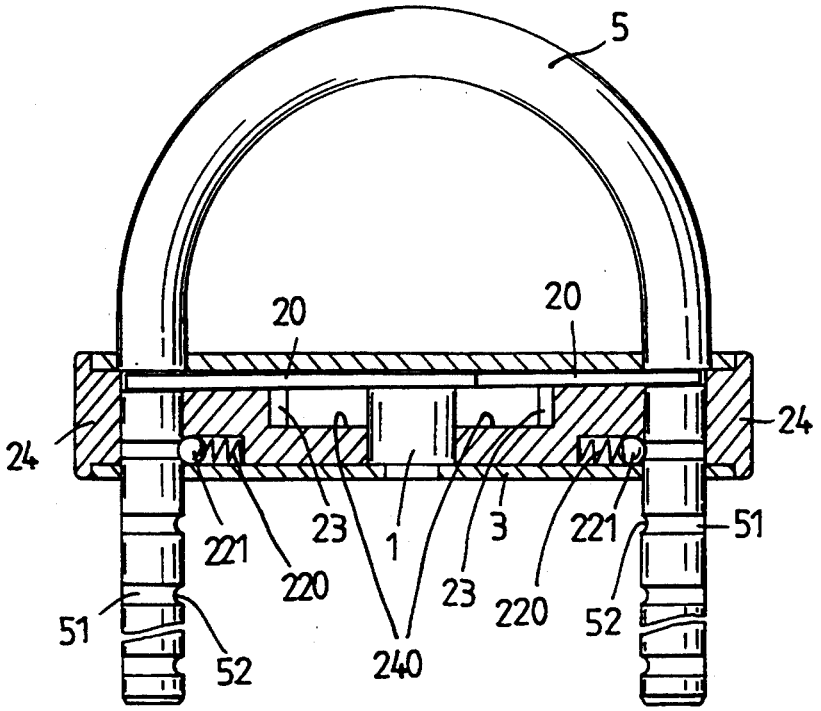
FIG. 5 is an assembly view in section of the padlock shown in FIG. 4.

Referring to FIGS. 4 and 5, a padlock in accordance with the present invention is generally comprised of a casing 3, a shackle 5, a lock cylinder 1, two sliding lock plates 20, a gear 2, two locating blocks 24, and two spring and steel ball sets 22.

The lock cylinder 1 is fastened to the casing 3 on the inside by a rivet 30. The gear 2 is mounted on the spindle 10 of the lock cylinder 1 and turned to move the sliding lock plates 20 toward to or apart from each other. The sliding lock plate 20 comprises a toothed portion 2010 at one end 201 thereof meshed with the gear 2, a slot 2001 linked to an arched opening 200 at an opposite end 200 thereof, and a bottom rod 23 in the middle. The spring and Steel ball set 22 is comprised of a spring 220 and a steel ball 221 and received in a bottom recess on each locating block 24. The locating block 24 comprises a vertical through hole 241 disposed near one end thereof aligned with each shackle hole 31 on the casing 3, and a sliding groove 240 horizontally disposed at an opposite end thereof which receives the bottom rod 23 of each sliding lock plate 20. When assembled, the two sliding lock plates 200 are disposed above the locating blocks 24 inside the casing 3 and driven by the lock cylinder 1 through the gear 2 to slide in the horizontal direction.

Figure 6:
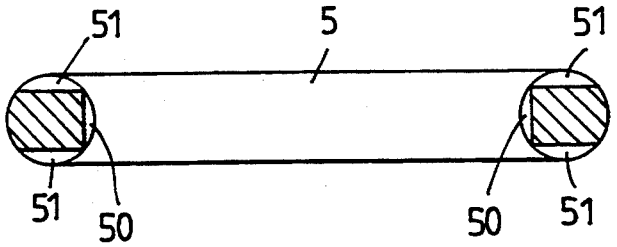
FIG. 6 is a plain view showing the structure of the neck portions of the shackle for the padlock shown in FIG. 4.

Referring to FIG. 6 and FIG. 5 again, the two opposite ends 50 of the shackle 5 are respectively inserted through the shackle holes 31 on the casing 3 and the vertical through hole 241 one each locating block 24 and locked in any of a series of vertical positions by the sliding lock plates 20. The two opposite ends 50 of the shackle 5 are made symmetrical, having a plurality of neck portions spaced at different elevation, each neck portion being defined by two opposite side grooves 51 and an inner groove 52 linked between the side grooves 51 at right angles. Because the neck portions and the grooves 51, 52 are respectively disposed at the same positions, the neck portions are not referenced by any number code. The distance between the side grooves 51 is approximately equal to the width of the slot 2001 on each sliding lock plate 20. The distance between each two neck portions of each end 50 of the shackle 5 is equal to the distance between the sliding lock plates 20 and the spring & steel ball sets 22. When the padlock is locked, the slot 2001 of each sliding lock plate 20 and the side grooves 51 of each neck portion of each end 50 of the shackle 5 are engaged together portions 51, 52 can be alternatively, and the steel ball 221 of either spring and steel ball set 22 engages into a respective inner groove 52. When the two opposite ends 50 of the shackle 5 are inserted through the shackle holes 31 on the casing 3 and the vertical through holes 241 on the two locating blocks 24, the steel ball 221 of each spring and steel ball sets 22 will engage into each inner groove 52 on each end 50 of the shackle 5. When the steel bails 221 of the spring and steel ball sets 22 are respectively engaged into each inner groove 52 on each end 50 of the shackle 5, the shackle 5 is retained in position and can still be moved in the shackle holes 31 by force. Under this stage, the operator can turn the spindle 10 of the lock cylinder 1 with the key to lock the shackle 5.

Figure 7:
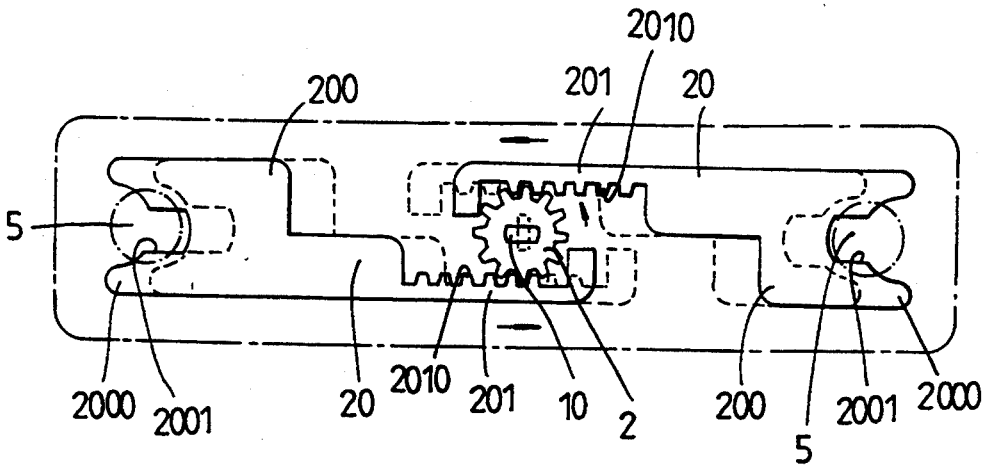
FIG. 7 shows the sliding lock plates of the padlock shown in FIG. 4 driven by the gear thereof.

Referring to FIG. 7, when the gear 2 is turned clockwise through 45° angle by the spindle 10 of the lock cylinder 1, the sliding lock plates 20 are moved outwards causing the slot 2001 of each sliding lock plate 20 engaged with each neck portion of each end 50 of the shackle 5, and therefore the shackle 5 is locked. On the contrary, when the gear 2 is turned counter-clockwise through 45° angle, the sliding lock plates 20 are moved inwards toward each other causing the slot 2001 released from the respective neck portion on each end 50 of the shackle 5, and therefore the shackle 5 is unlocked and can be removed from the casing 3.

Figure 8:
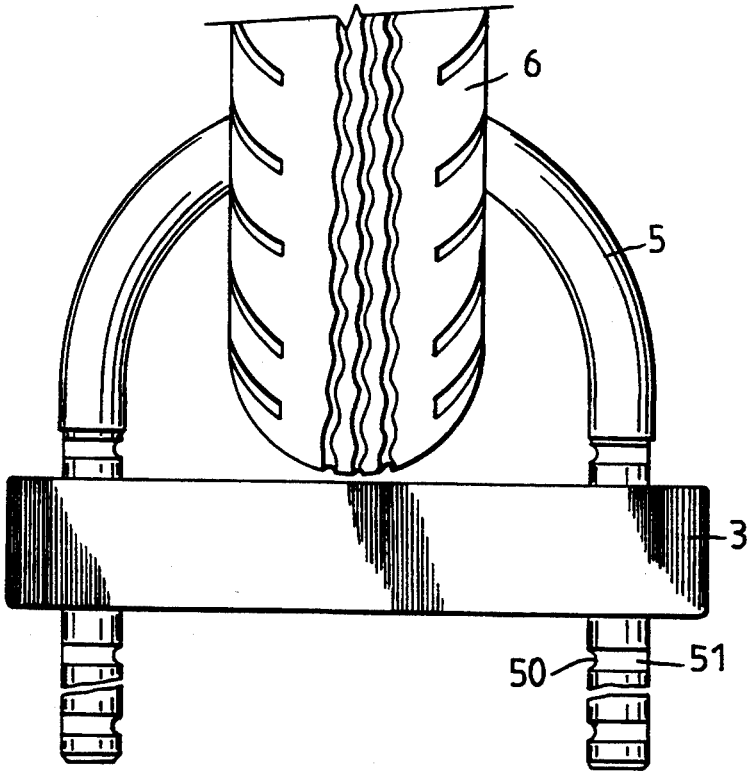
FIG. 8 is an installed view showing the padlock of the present invention fastened to an object.

Referring to FIG. 8, the shackle 5 can be locked in any of a series of locking positions to change the constraint space defining within the shackle 5 and the casing 3 according to the thickness of the object 6 being fastened.

I claim:

1. A padlock comprising:

a shackle having series of neck portions longitudinally spaced along two opposite ends thereof, each neck portion being defined by two opposite side grooves and an inner groove linked between said side grooves;

a casing having two shackle holes through two opposite ends thereof for passing each end of said shackle;

two locating blocks fastened to the two opposite ends of said casing on the inside, each locating block having a vertical through hole vertically disposed at one end and longitudinally aligned with each shackle hole on said casing for passing each end of said shackle, a sliding groove horizontally disposed at an opposite end at the top, and a bottom recess on a bottom wall thereof near said vertical through hole;

a lock cylinder mounted inside said casing between said locating blocks and having a spindle vertically extended out of a top thereof;

a gear mounted on said spindle and turned by said lock cylinder through a key;

two sliding lock plates respectively disposed above said locating blocks, said sliding lock plates having each a toothed portion at one end thereof meshed with said gear at each side, a slot linked with an arched opening at an opposite end thereof, and a bottom rod being slidably mounted in each of said sliding grooves of said locating blocks;

two spring and steel ball sets respectively disposed in the bottom recess of each of said locating blocks, each of said spring and steel ball sets comprising a spring and a steel ball supported on the spring to engage into each of said inner grooves on said shackle; and wherein when said gear is turned clockwise through 45° angle, said sliding lock plates are moved apart causing the slot of each sliding lock plate to engage with each neck portion of each end of said shackle in locking engagement; when said gear is turned counter-clockwise through 45° angle, said sliding lock plates are moved toward each other causing the slot of each sliding lock plate to remove from each end of said shackle permitting each end of said shackle to be disposed in the arched opening of each sliding lock plate, and therefore the shackle is unlocked and can be removed from said casing.

2. The padlock of claim 1 wherein the distance between two adjacent neck portions on each end of said shackle is equal to the distance between said sliding lock plates and said spring and steel ball sets.

3. The padlock of claim 1 wherein said inner groove is linked between said two opposite side grooves at right angles.

* * * * *